United States Patent [19]

Terazawa

[11] 3,942,919

[45] Mar. 9, 1976

[54] ROTARY PISTON TYPE ENGINE

[75] Inventor: Yasuto Terazawa, Hiroshima, Japan

[73] Assignee: Toyo Kogyo Co., Ltd., Japan

[22] Filed: Nov. 7, 1973

[21] Appl. No.: 413,516

[30] Foreign Application Priority Data

Nov. 8, 1972 Japan ..... 47-128729

[52] U.S. Cl. ..... 418/83; 418/149

[51] Int. Cl.[2] ..... F01C 21/06

[58] Field of Search ..... 418/83, 149, 101; 123/8.01; 165/147

[56] References Cited

UNITED STATES PATENTS

| | | | |
|---|---|---|---|
| 2,875,985 | 3/1959 | Hold | 165/147 |
| 3,007,460 | 11/1961 | Bentele et al. | 418/83 |
| 3,250,260 | 5/1906 | Heydrich | 418/101 |
| 3,575,538 | 4/1971 | Berkowitz | 418/83 |
| 3,644,070 | 2/1972 | Lermusiaux | 418/83 |
| 3,691,999 | 9/1972 | Lechler et al. | 123/8.01 |
| 3,799,708 | 3/1974 | Leptien | 418/83 |
| 3,830,598 | 8/1974 | Ruf | 418/83 |

FOREIGN PATENTS OR APPLICATIONS

| | | | |
|---|---|---|---|
| 704,571 | 3/1965 | Canada | 123/8.01 |

*Primary Examiner*—C. J. Husar
*Attorney, Agent, or Firm*—Fleit & Jacobson

[57] ABSTRACT

A rotary piston type engine comprising a casing and a rotor in said casing, said casing including a center housing and a pair of side housings secured to the center housing at the opposite sides thereof, a plurality of cooling fluid passages extending axially through said center housing and communicating with corresponding passages in said side housings, each of said passages in said center housing being inclined from the opposite ends thereof to the intermediate portion thereof toward radially inwardly of the casing, and also decreased in the cross-sectional area at the intermediate portion.

2 Claims, 3 Drawing Figures

ROTARY PISTON TYPE ENGINE

The present invention relates to a rotary piston type internal combustion engine and more particularly to cooling fluid passage means therefor.

In a rotary piston type engine comprising a rotor casing having a center housing provided with a trochoidal inner peripheral wall and a pair of side housings sealing secured to the opposite sides of the center housing, and a substantially triangular rotary piston disposed in said casing to define working chambers of variable volume with said casing, it is a well known fact that the inner peripheral wall is subjected to a serious thermal condition. Conventionally, the center housing is provided with a plurality of axially extending passages for allowing cooling fluid to pass therethrough. The passages open at the opposite sides of the center housing and in communication with cooling fluid passages formed in the side housings. Thus, the cooling fluid such as water is passed from one of the side housings through the passages in the center housing to the other of the side housings. Since the inner wall of the center housing is subjected to serious thermal condition as described above, the wall thickness at the area of the cooling fluid passages should preferably be as thin as possible. On the other hand, in order to provide sealing means between the center housing and the side housings, the center housing must have a certain amount of wall thickness even at the area of the cooling fluid passage at the opposite sides thereof. Thus, according to a known arrangement, each of the cooling fluid passages in the center housing has relatively narrow inlet and outlet openings, with the intermediate portion expanded radially inwardly of the center housing so as to provide a sufficiently reduced thickness of the inner wall.

The known configuration of the cooling fluid passages in the center housing is, however, disadvantageous in that, since the cross-sectional area of the passage is substantially increased at the intermediate portion thereof, stagnation of coolant flow is produced therein remarkably reducing the cooling effect of the coolant flowing therethrough.

The present invention has an object to eliminate the aformentioned problems in the conventional arrangement.

A further object of the present invention is to provide effective cooling fluid passage means for a rotary piston type engine.

Still further object of the present invention is to eliminate stagnation of coolant flow in the center housing of the rotary piston type engine.

According to the present invention, there is provided a rotary piston type internal combustion engine comprising a casing which includes a center housing having a trochoidal inner peripheral wall surface and a pair of side housings sealingly secured to the center housing at the opposite sides thereof, a substantially triangular rotary piston disposed in the center housing to define working chambers with said housings, cooling fluid passage means axially extending through said center housing and communicating with corresponding passage means in said side housings so as to allow flow of cooling fluid to pass from one of the side housings through said passage means in the center housing to the other side housing, characterized by the fact that said cooling fluid passage means in the center housing includes a plurality of passages each of which is inclined radially inwardly of the center housing from the ends to the intermediate portion of the passage. Preferably, the passage is reduced in cross-sectional area at the intermediate portion so that the flow speed of the cooling fluid is increased at the intermediate portion of the passage to provide an increased cooling effect.

The above and other objects and features of the present invention will become apparent from the following description of the preferred embodiments taking reference to the accompanying drawings, in which.

Figure 1:
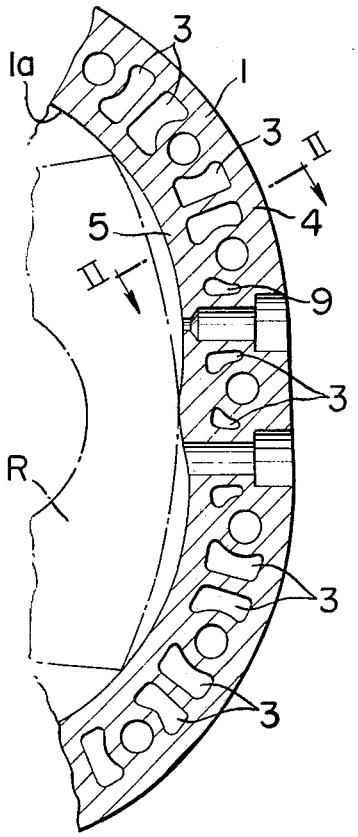
FIG. 1 is a sectional view of a center housing of a rotary piston type engine embodying the present invention.
Figure 2:
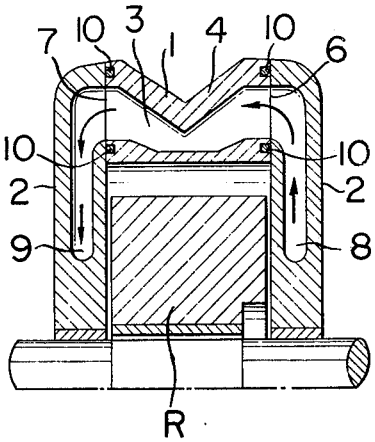
FIG. 2 is a sectional view taken substantially along the line II—II in FIG. 1.

Referring now to the drawings, particularly to FIGS. 1 and 2, the illustrated rotary piston type engine includes a casing which comprises a center or rotor housing 1 having a trochoidal inner peripheral wall surface 1*a* and a pair of side housings 2 secured to the opposite sides of the center housing 1. In the center housing 1, there is disposed a triangular rotary piston R which may be of a conventional configuration. As shown in FIG. 2, the center housing 1 is provided with a plurality of axially extending cooling liquid passages 3 leaving an outer wall portion 4 and an inner wall portion 5 in the center housing 1. Each of the passages 3 has an inlet 6 and an outlet 7 at the opposite ends thereof for communication with corresponding cooling liquid passages 8 and 9 provided in the side housings 2. Thus, cooling liquid flows as shown by arrows in FIG. 2 from the passages 8 in one of the side housings 2 through the passages 3 in the center housing 1 to the passage 9 in the other side housing 2. Between the center housing 1 and each of the side housings 2, there are disposed sealing members such as O-rings 10. As shown in FIG. 2, each of the passages 3 in the center housing 1 is inclined from the opposite ends 6 and 7 to the intermediate portion thereof in the radially inward direction of the casing so as to reduce the wall thickness of the inner wall portion 5 of the center housing 1. Further, the cross-sectional area of the passage 3 is decreased at the intermediate portion thereof than at the opposite end portions. This configuration provides increased coolant flow speed at the intermediate portion of the passage 3 and prevents formation of flow stagnation in the passage. In the embodiment shown in FIG. 2, the center housing 1 is recessed at the outer peripheral surface thereof in order to reduce the weight of the casing.

Figure 3:
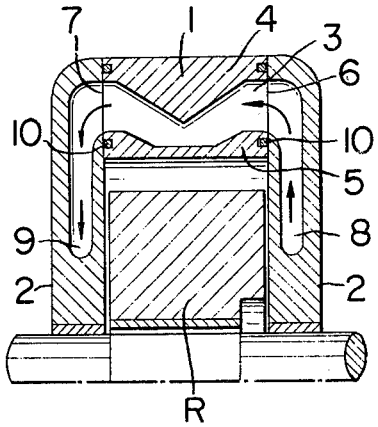
FIG. 3 is a sectional view similar to FIG. 2 but showing another embodiment of the present invention.

FIG. 3 shows another embodiment of the present invention in which corresponding parts are designated by the same references as in FIGS. 1 and 2. This embodiment differs from the embodiment shown in FIGS. 1 and 2 only in that the center housing 1 is not recessed at the outer peripheral surface.

The invention has thus been shown and described with reference to specific embodiments which are illustrated in the drawings, however, it should be noted that the invention is in no way limited to the details of the illustrated arrangements and changes and modifications can be made without departing from the scope of the appended claims.

I claim:

1. Means for cooling a rotary piston type internal combustion engine having a casing with a pair of side housings comprising:

a central housing having inner and outer walls defining a plurality of cooling fluid passages, each cooling fluid passage extending axially through said central housing and having inlet and outlet portions in fluid communication with fluid passages in the side housings and an intermediate portion between said inlet and outlet portions of each of said cooling fluid passages, said inner wall having a thickness at said intermediate portion which is less than the thickness of said inner wall at said inlet and outlet portions, said outer wall being inclined inwardly of said central housing from said passage inlet and outlet portions to reduce the cross-sectional area of said fluid passage adjacent said intermediate portion from the cross-sectional areas adjacent said inlet and outlet portions.

2. A rotary piston type engine in accordance with claim 1 in which said center housing is recessed at the outer peripheral surface thereof.

* * * * *